US005350028A

United States Patent [19]

Boulet

[11] Patent Number: 5,350,028

[45] Date of Patent: Sep. 27, 1994

[54] DEVICE FOR ADJUSTING THE PATH OF A ROTARY DRILLING TOOL

[75] Inventor: Jean Boulet, Paris, France

[73] Assignee: Institut Francais du Petrole, Rueil-Malmaison, France

[21] Appl. No.: 983,533

[22] PCT Filed: Jun. 24, 1992

[86] PCT No.: PCT/FR92/00578

§ 371 Date: Apr. 28, 1993

§ 102(e) Date: Apr. 28, 1993

[87] PCT Pub. No.: WO93/01390

PCT Pub. Date: Jan. 21, 1993

[30] Foreign Application Priority Data

Jul. 4, 1991 [FR] France ..... 91 08405

[51] Int. Cl.[5] ..... E21B 7/08

[52] U.S. Cl. ..... 175/26; 175/76

[58] Field of Search ..... 175/26, 73, 76, 325

[56] References Cited

U.S. PATENT DOCUMENTS 3,092,188 6/1963 Farris .
3,825,081 7/1974 McMahon .
3,851,719 12/1974 Thompson et al. .
4,465,147 8/1984 Feenstra et al. .
4,804,051 2/1989 Ho ..... 175/26
4,854,399 8/1989 Zijsling .
4,880,066 11/1989 Steiginga et al. ..... 175/76 X
4,982,802 1/1991 Warren et al. .
5,168,941 12/1992 Krueger et al. ..... 175/26
5,181,576 1/1993 Askew et al. ..... 175/76 X

FOREIGN PATENT DOCUMENTS 0058061 2/1982 European Pat. Off. .
2544375 4/1983 France .
2579662 4/1985 France .

*Primary Examiner*—Thuy M. Bui
*Attorney, Agent, or Firm*—Antonelli, Terry, Stout & Kraus

[57] ABSTRACT

The adjusting device consists of at least one drill string element (40) integral in rotation with the drill string and fastened to the drill string in the vicinity of the drill bit. Element (40) comprises parts (41, 43, 46) whose outer bearing surfaces are arranged in a cylindric surface with substantially the axis (48) of the drill string as the axis and substantially the nominal diameter of hole (4) as the diameter, distributed around the axis so as to generate, during part of the rotation of the drill string, by reaction of the well of hole (4) on element (40), forces tipping the drill bit out of the drilling plane. Bearing parts (45, 46) may consist partly of variable-diameter mobile blades.

9 Claims, 4 Drawing Sheets

DEVICE FOR ADJUSTING THE PATH OF A ROTARY DRILLING TOOL

BACKGROUND OF THE INVENTION

The invention relates to a device for adjusting the azimuth of the trajectory of a rotary-drilling bit.

In the case of rotary drilling, the drill bit is brought into rotation by a drill string one end of which located at the surface, is connected to a means for rotationally driving the drill bit.

The thrust load on the tool is also exerted by the drill string.

In current drilling techniques and particularly in oil drilling, there are well-known processes and devices for allowing a carrying out of a certain remote adjustment of the drill bit trajectory.

This adjustment may relate to a drift of the trajectory, with respect to the angle of this trajectory to the vertical or to the azimuth of the trajectory, to the angular position of a vertical drilling plane containing the axis of the hole or well, and/or with respect to a predetermined direction which is preferably the direction of the magnetic north.

The known devices and processes for adjusting the azimuth of the trajectory of a rotary-drilling bit require complex mechanical or electronic means comprising several mobile parts and imposing either a mechanical anchoring of part of the device inside the hole being drilled, or an electronic locating of the adjusting means with respect to the vertical drilling plane containing the axis of the hole or well in the process of being drilled.

The devices of the prior art which are used for adjusting the trajectory of a drill bit comprise means allowing the trajectory to be deflected in the wanted direction, which are connected to the drill string and which comprise bearing surfaces resting on the surface of the hole or wellbore, offset with respect to the drill string. When the means for adjusting the trajectory are set into operation, the bearing surfaces contact the inner surface of a hole in a wanted orientation.

Setting and actuating such adjusting devices is generally complex. It imposes the immobilization of said devices with respect to the wall of the wellbore and involves the use of a downhole motor.

SUMMARY OF THE INVENTION

The object of the invention is to propose a device for adjusting the azimuth of the trajectory of a rotary-drilling bit fastened to the end of a drill string rotating around the axis thereof arranged substantially along a vertical plane during drilling of a hole, the azimuth of the trajectory being defined by the angular position of the vertical plane or drilling plane with respect to a reference direction, with the device requiring no anchoring in the well and no locating of the adjusting means with respect to the drilling plane, and allowing an adjustment of the azimuth towards the right as well as towards the left of the drilling plane, in the direction of penetration of the drilling.

To that effect, the device according to the invention includes at least one drill string element integral with the drill string in rotation and fastened to the drill string in a vicinity of the drill bit, comprising, in cross-section parts whose outer bearing surfaces are arranged in a cylindrical surface having an axis merging or substantially merging with the axis of the drill string and a maximum diameter equal to or substantially equal to the nominal diameter of the hole, distributed around the axis of the drill string, so as to generate, during the rotation of the drill string, by reaction of the wall of the hole on the element, forces tipping the drill bit out of the drilling plane, either to the right or to the left of the drilling plane, during part of a full rotation of the drill string, and to hold the drill string substantially along the axis of the hole during the rest of the rotation.

BRIEF DESCRIPTION OF THE DRAWINGS

Other features and advantages of the invention will be clear from reading the description hereafter of several embodiments of a device for adjusting the azimuth of the trajectory of a rotary-drilling bit according to the invention, with reference to the accompanying drawings in which.

DESCRIPTION OF THE PREFERRED EMBODIMENTS

Figure 1:
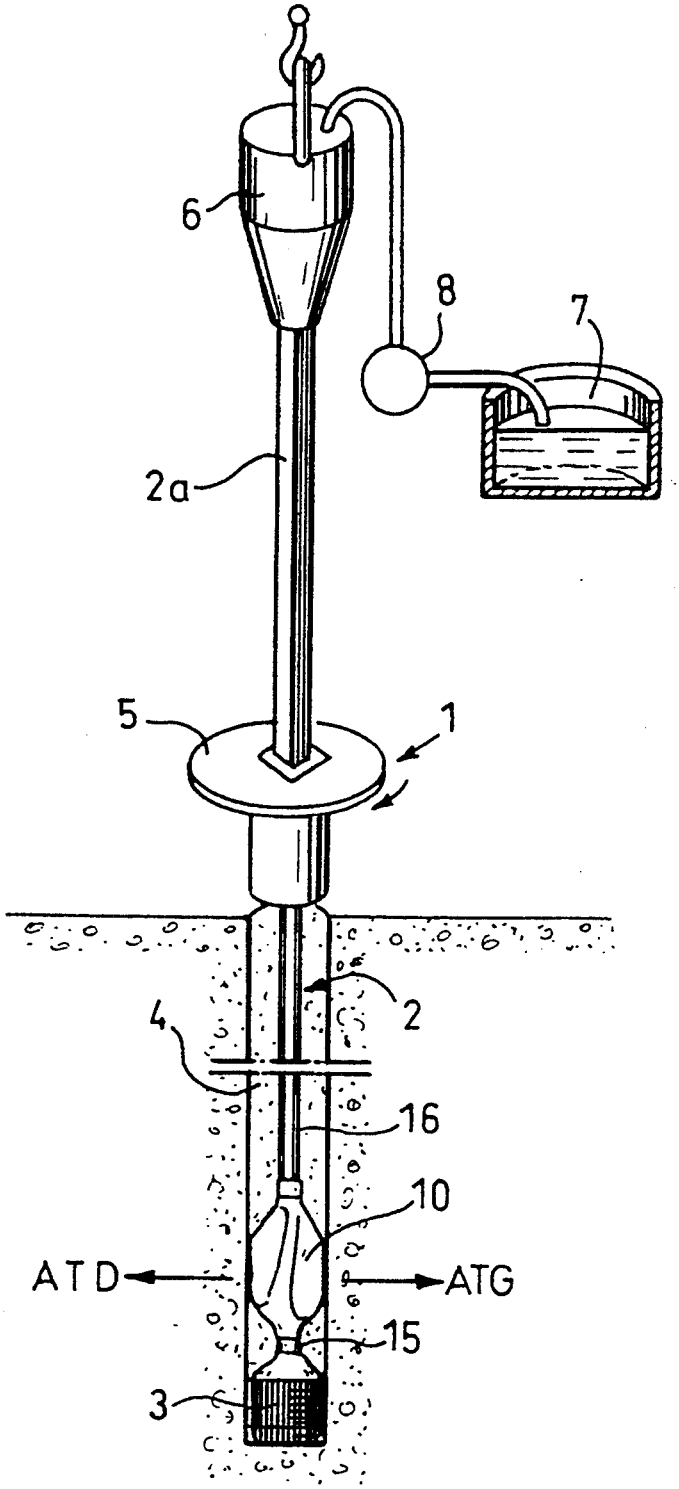
FIG. 1 is a schematic perspective view of a rotary-drilling device.

FIG. 1 shows a rotary-drilling device 1 whose drill string 2 bears at the end thereof a drill bit 3 progressing so as to drill a wellbore 4.

The end of the drill string located opposite bit 3, is connected to a device 5 for driving drill string 2 in rotation around the axis thereof.

Pipe 2*a* located at the top of drill string 2 has a square section and the device 5 for driving the drill string in rotation includes a horizontal rotary table crossed by an opening for allowing the square pipe to fit through. The rotation of the table through a motive assembly allows square pipe 2*a* and drill string 2 to be driven in rotation while allowing the axial displacement of the drill string for drilling.

The lower part of the drill string, being maintained in compression, will exert a thrust load on the drill string 2 and on the bit allowing the application thereof with a sufficient pressure on the bottom of wellbore 4.

Besides, the upper end of the drill string constituting the first end thereof, opposite the second end connected to drill bit 3, comprises a drilling swivel 6 for injecting the drilling fluid, connected to the first pipe 2*a* so as to inject in the inner bore thereof the drilling fluid under pressure. The drilling fluid circulates in the axial direction, inside the drill string and over the total length thereof so as to reach the lower part of the drilling device, at the level of bit 3. The drilling fluid sweeps the bottom of wellbore 4 and then flows back up towards the surface in the annular space located between the drill string and the wall of the wellbore while carrying along rock debris torn off by drill bit 3.

The drilling fluid laden with debris is recovered at the surface, separated from the debris and recycled in a tank 7. A pump 8 allows the drilling fluid to be fed into drilling swivel 6 again.

Drilling device 1 comprises, in the lower part thereof, a drill string element constituting an azimuth-adjusting device or assembly 10 according to the invention, which will be described in a more detailed way with reference to FIG. 5 and FIGS. 6 to 8.

The adjusting device or assembly 10 is directly connected to drill bit 3 by a junction zone 15 defining a bearing face for assembly 10 on bit 3.

Figure 2:
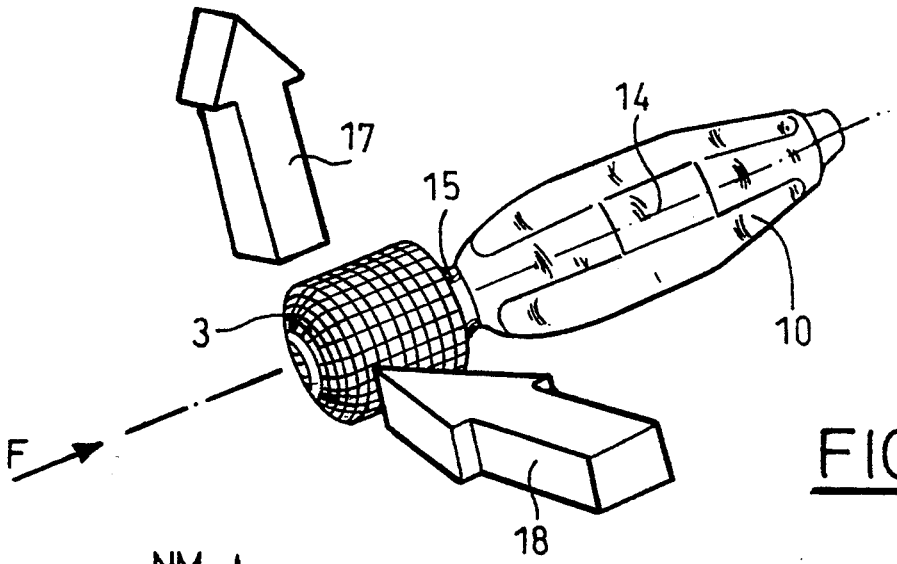
FIG. 2 is a schematic perspective view of a rotary-drilling bit to which an adjusting element according to the invention is associated.

FIG. 2 shows bit 3, connected to adjusting element 10 by junction zone 15, with the assembly 10 being itself connected to the upper section 16 of the drill string 2, as shown in FIG. 1. Drill bit 3 is rotated around the axis 14 of the drill string so as to carry out the drilling of the well bore 4.

In FIG. 1, the drill string 2 is shown in a vertical position but, in case of directional drilling, this drill string 2 exhibits a certain drift with respect to the vertical direction.

In FIG. 2, drill bit 3, the element and the axis 14 of the drill string 2 merged with the axis of hole 4 are shown in an inclined position. The axis 14 of the drill string 2 and of well bore 4 is arranged in a vertical plane called "drilling plane".

During drilling, forces are exerted on the surface of the wellbore 4, particularly by the drill bit 3, and are translated into transverse reactions which are transmitted to the drill bit 3 and which allow the trajectory of the drill bit 3 to be adjusted.

These transverse reactions comprise components located in the drilling plane, whose resultant is diagrammatically shown in FIG. 2 by arrow 17.

These transverse reactions also comprise components perpendicular to the drilling plane whose resultant is diagrammatically shown in FIG. 2 by arrow 18. These transverse components, perpendicular to the drilling plane, allow the azimuth of the trajectory, that is, the angular position of the drilling plane with respect to a fixed reference, to be adjusted. This resultant perpendicular to the drilling plane may be directed towards the right or towards the left, for an observer looking in the drilling penetration direction.

This resultant allows a tipping of the drill string 2 to the right or to the left with respect to the drilling plane, and therefore an adjustment of the azimuth of the trajectory of the drill bit 3 by controlling transverse component 18.

Figure 3:
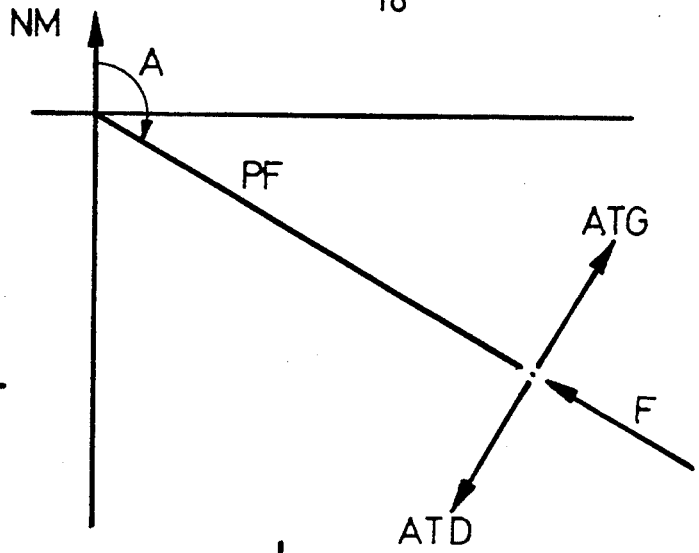
FIG. 3 is a diagram showing the working principle of the device for adjusting the azimuth according to the invention.

FIG. 3 shows the direction NM of the magnetic north and the trace PF of the drilling plane which is the vertical plane containing the axis of the wellbore 4 or merged with the axis 14 of the drill string 2 in an inclined position with respect to the vertical during drilling, as shown in FIG. 2.

Angle A determining the angular position of the drilling plane with respect to the magnetic north corresponds to the azimuth which is being adjusted.

Figure 4:
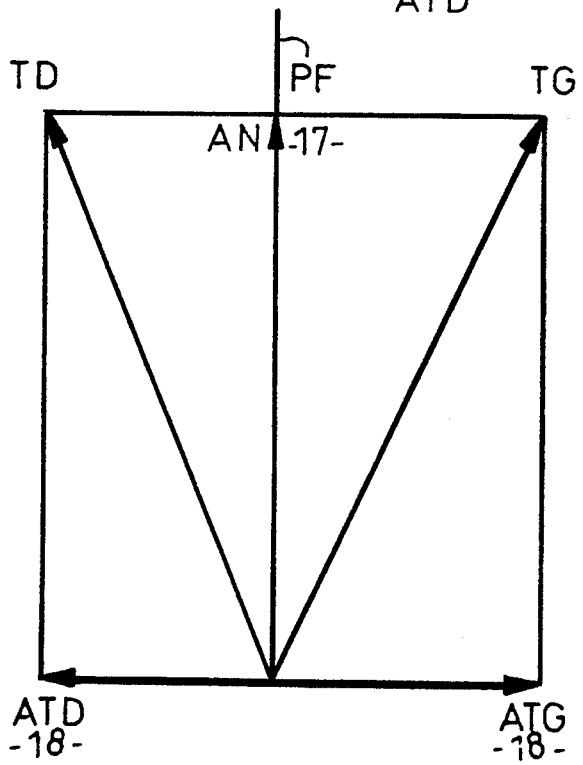
FIG. 4 shows the forces exerted at the level of the adjusting element, in a plane perpendicular to the axis of the drill string.

The transverse forces applied during drilling are shown in FIG. 4, in a plane perpendicular to the drilling plane and direction, for an observer looking in the direction F opposite the drilling penetration direction.

FIG. 4 shows the resultant of the transverse forces in the case where this resultant TD is directed upwards and towards the right of the drilling plane and in the case where this resultant TG is directed upwards and towards the left of the drilling plane PF. The resultant forces TD and TG have a component AN in the drilling plane of vertical direction and directed upwards. This component allows the drift of the drill string 2 and of the well bore 4 to be adjusted. Resultant TD exhibits an azimuth component ATD perpendicular to the drilling plane and directed towards the right.

Resultant TG exhibits an azimuth component ATG perpendicular to the drilling plane and directed towards the left.

The azimuth-adjusting device according to the invention includes the assembly 10 integral with the drill string 2 in rotation and located in the drill vicinity of the bit 3 which is likely to generate, during the rotation of the drill string 2, by reaction of the wall of the well bore 4 on the element, a transverse force such as TD or TG having an azimuth component directed either towards the right or towards the left, according to the azimuth correction to be achieved at a given time.

Figure 5:
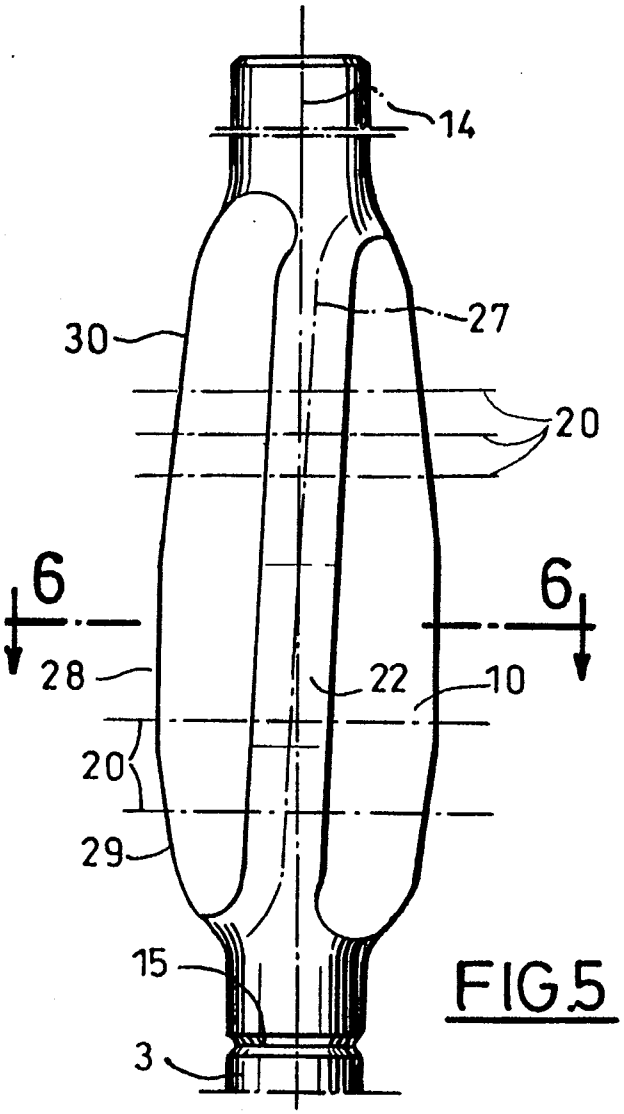
FIG. 5 is a front view of an adjusting element according to the invention.

FIG. 5 depicts the element 10 whose profiled shape will be described hereinafter, which is fastened to the drill bit 3 at the level of bearing face 15 at the lower part thereof and to the upper section of the drill string 2 at the upper end thereof.

Assembly 10 has a profiled shape in the axis 14 of the drill string 2 as well as in the transverse planes 20 perpendicular to axis 14.

Figure 6:
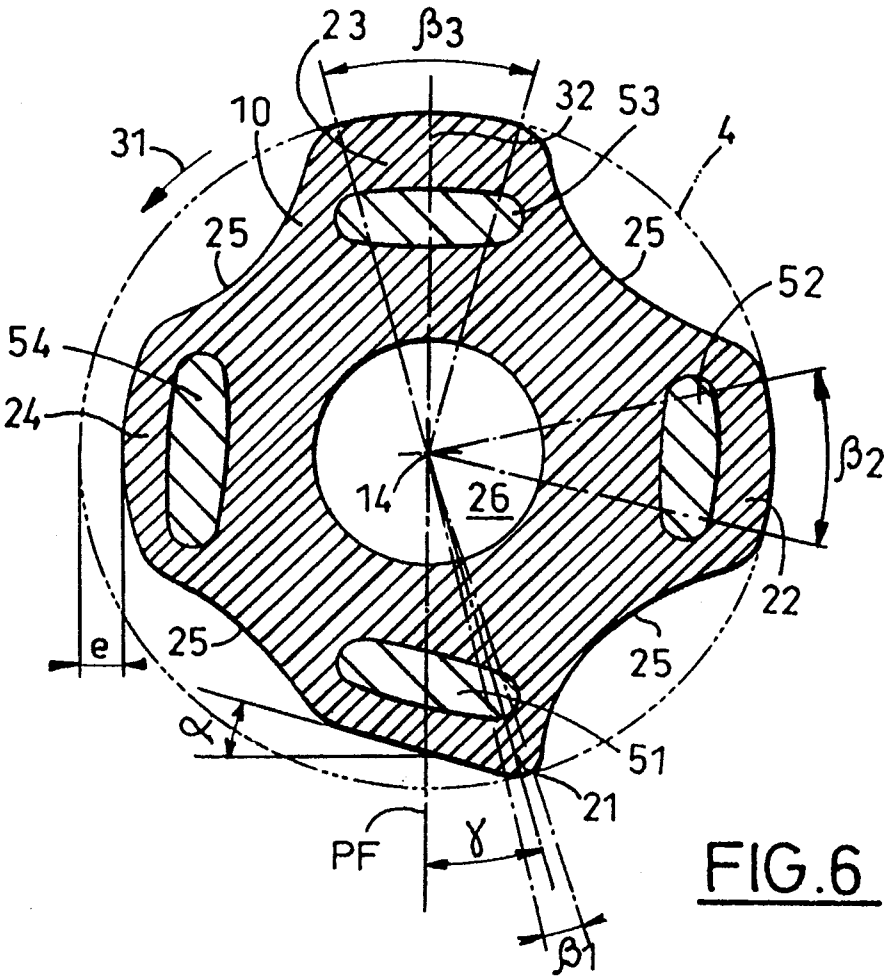
FIG. 6 is a cross section taken along line 6—6 of FIG. 5, in the case of an adjusting element allowing forces tipping the drill string to the right to be generated.
Figure 8:
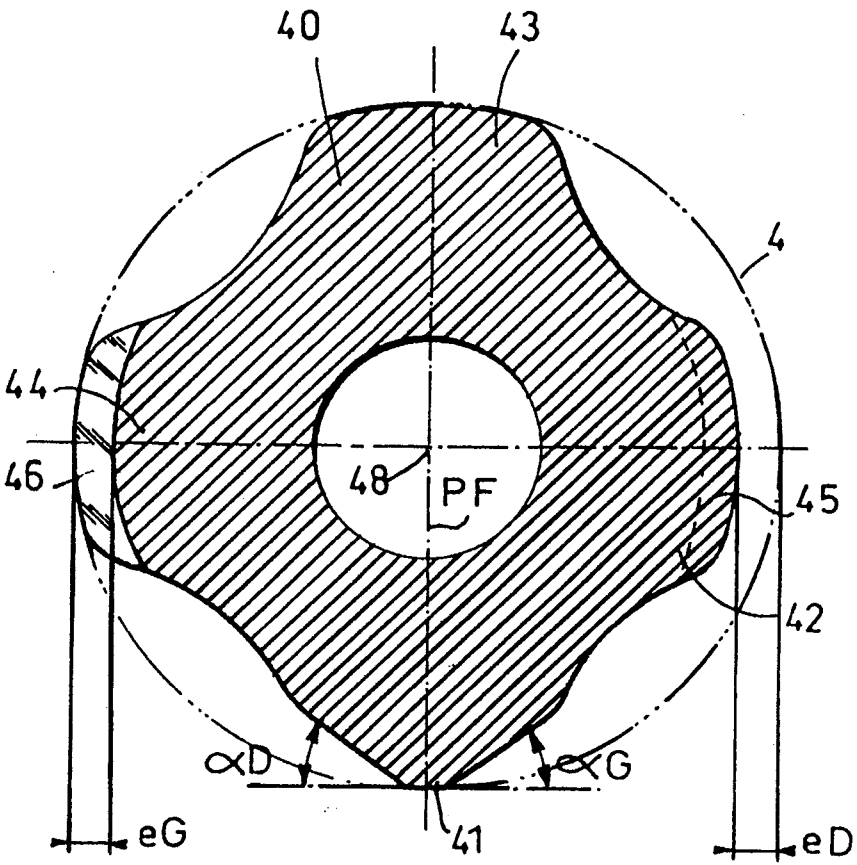
FIG. 8 is a cross section, analogous to the views of FIGS. 6 and 7, of an adjusting element fitted with variable diameter blades allowing forces tipping the drill string either to the right or to the left to be generated.
Figure 7:
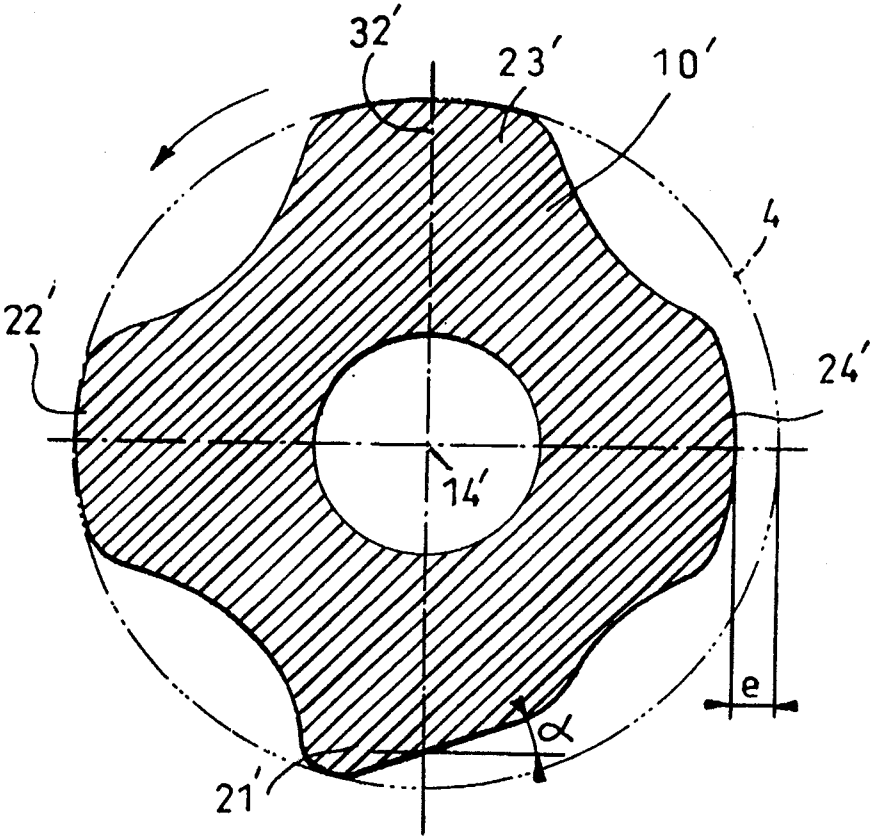
FIG. 7 is a cross section, analogous to the view of FIG. 6, of an adjusting element allowing forces tipping the drill string to the left to be generated.

The shape of the cross-section of the assembly 10 is shown in FIGS. 6, 7 and 8 in three different cases.

In the case of a given adjusting element, the cross-sections of the element through the successive planes 20 have similar shapes modified in a progressive way due to the profiling of the element in the axial direction 14.

According to the shape of the cross-sections, the element may allow to tip the drill string 2 and the drill bit 3 to the right of the drilling plane (case of FIG. 6) or to the left of the drilling plane (case of FIG. 7), or else either to the right or to the left through the control of variable-diameter blades (case of FIG. 8).

In all these cases, the peak diameter of the element is substantially equal to the nominal diameter of the cross-section of hole 4.

As can be seen in FIG. 6, the cross-section of element 10 exhibits radial salient parts 21, 22, 23 and 24 separated by recesses 25.

Salient parts 21, 22 and 23 comprise outer bearing surfaces located on a cylinder having an axis merged or substantially merged with the axis 14 of the drill string 2 and of the element and the diameter of the wellbore 4 as the diameter.

Salient part 24 comprises an outer surface standing back by a distance e with respect to the inner surface of wellbore 4.

Salient parts 21, 22 and 23 constitute bearing blades comparable to the blades of a stabilizer for adjusting the trajectory of a drill bit 3. However, the salient parts of the assembly 10 have a peak diameter equal to or slightly smaller than the nominal diameter of the wellbore and tipping the drill string 2 with respect to the drilling plane is obtained dynamically, during the rotation of the element, under the effect of the reaction of the wall of the wellbore 4 on the element whose salient parts are distributed circumferentially around the axis of the assembly, so as to generate an unsymmetry of the forces.

In the case of conventional stabilizers used with a downhole motor for controlling the azimuth, transverse static forces are generated through the permanent eccentricity of the axis of the salient parts with respect to the axis of the drill string, which thus imposes an immobilization of the drill string 2 to carry out the control.

The assembly 10 comprises a central channel 26 extending in an axial direction allowing a continuity of the drilling fluid circulation to be ensured between the upper section of the drill string 2 and the drill bit 3.

As can be seen in FIG. 5, the salient parts of the assembly 10, such as the salient part 22, may be placed in such a way that the longitudinal axis 27 is inclined with respect to the axis 14 of the assembly 10 and of the drill string 2.

The assembly 10 comprises a central part 28 in which the bearing blades have a peak diameter corresponding substantially to the nominal diameter of the wellbore 4 and two inclined parts 29 and 30 located on either side of part 28 in which the diameter of the bearing blades progressively decreases towards the ends of the assembly 10. This profiled shape in the axial direction of the element 10 allows the fitting and the progress of the element within the wellbore 4 to be facilitated.

It is obvious that the various parameters (angles or sizes) defining the geometric shape of the assembly 10 will be selected by the skilled artisan as a function of the use of the drill string 2.

The main features of the adjusting element relative to the shape and the distribution of the salient bearing parts are visible on the cross-section of this element shown in FIG. 6.

The bearing parts 22 and 23 which are placed substantially at 90° in relation to one another around the axis 14 of the assembly comprise outer surfaces of substantially cylindrical shape whose cross-section consists of the arc of a circle seen from an angle $\beta 2$ (or $\beta 3$) from the axis 14 of the element. Angles $\beta 2$ and $\beta 3$ are substantially equal.

Salient part 21 has an outer bearing surface consisting of the arc of a circle whose aperture angle $\beta 1$ from the axis 14 of the element is substantially smaller than $\beta 2$ and $\beta 3$.

Besides, salient part 21 is offset by an angle $\gamma$ with respect to the diametral direction passing through the center of bearing part 23.

In FIG. 6, element 10 is shown in a determined position during the rotation thereof within wellbore 4 whose axis 14 is inclined to the vertical.

The salient part 23 of element 10 is located at the upper part of hole 4 and part 21 in the vicinity of the lower generatrix of wellbore 4. The section of the element shown in FIG. 6 is seen in a direction opposite the drilling penetration direction F. The trace of the vertical drilling plane PF corresponds to the diameter of the cross-section of the element on which salient part 23 is centered.

The offset $\gamma$ of the salient part 21 comprising the small-size bearing surface $\beta 1$ is oriented towards the right of the drilling plane PF (opposite the drilling direction).

The surface of element 10, at the level of salient part 21, is relief machined so as to constitute a recess inclined by an angle $\alpha$ with respect to the perpendicular of the diameter corresponding to the trace of the drilling plane PF.

When the drill string 2 and the assembly 10 are rotated, for example in the direction shown by arrow 31, the reactions of the wall of the hole on element 10 are distributed unsymmetrically with respect to the axis 14 of the element, due to the unsymmetric circumferential distribution of the outer bearing surfaces of the salient parts.

The resultant of the transverse reaction forces will be directed towards the right of the drilling plane PF with respect to the drilling penetration direction.

The assembly 10, the drill string 2 and the drill bit 3 are thus tipped towards the right of the drilling plane, which allows to achieve a certain correction of the azimuth that is determined by the shape of assembly 10.

During the rotation of the drill string 2 and of the adjusting assembly 10 in the direction shown by arrow 31, tipping of the assembly 10 and of the drill string 2 towards the right decreases progressively whereas the downward tipping of the drill string 2 increases during the rotation.

When the assembly 10 has rotated by an angle of substantially 90°, from the position shown in FIG. 6, tipping of the assembly 10 only takes place in the vertical direction and downwards, that is in the drilling plane.

No azimuth correction is carried out during this part of the rotation.

When the bearing part 21 of the element is in the vicinity of the upper generatrix of wellbore 4, after the assembly 10 has performed a half turn, salient part 23 of the assembly 10 rests on the lower part of the well bore 4, and the assembly 10 and the drill string 2 are perfectly maintained in a direction corresponding to the axis of the hole.

Tipping can only occur when bearing part 21 has come back into the lower part of the wellbore 4. Azimuth correction is always carried out towards the right, by using the assembly as shown in FIG. 6.

Tipping the element to the right during part of the rotation is made possible by the absence of a bearing zone for the assembly 10 on the wall of the wellbore 4 on one side of the axial plane of the assembly passing through bearing zone 21 having a small aperture angle $\beta 1$ and by the presence of a bearing zone 22 having a large aperture angle $\beta 2$ on the other side of the axial plane passing through bearing zone 21.

The main parameters of the element defining the geometric shape thereof are the small aperture angle $\beta 1$ of one of the bearing zones, the angle of offset $\gamma$ of this zone of small bearing surface with respect to the axial plane passing through a bearing zone of wide aperture $\beta 3$ and the distance e between the outer surface of the element and the wall of the wellbore, in a zone substantially diametrically opposite a bearing zone 22 of wide aperture angle $\beta 2$ interposed between zones 21 and 23.

The geometry of bearing zone 21 of small aperture is also defined by the angle of inclination $\alpha$ of the junction surface of this bearing zone allowing the element to be tipped towards the right.

FIG. 7 shows an assembly 10' allowing the drill string 2 and the drill bit 3 to be tipped towards the left of the drilling plane, during the rotation of the drill string 2 and of the assembly 10'.

The shape of the cross-section of assembly 10' is symmetrical to the shape of the cross-section of assembly 10 shown in FIG. 6, with respect to the trace 32 (or 32') of the drilling plane, the assembly being placed, with respect to the drilling plane, in the position shown in FIG. 6.

The assembly 10' comprises salient parts 21', 22', 23' and 24'.

Parts 21', 22', 23' are located on a cylinder whose axis merges or substantially merges with the axis of the assembly 10' and whose diameter corresponds substantially to the nominal diameter of the wellbore 4.

Bearing parts 22', 23' which are arranged substantially at 90° with respect to one another around the axis of the assembly 10 have an outer surface of contact with the wall of the well bore 4. Bearing part 21' has a small contact surface and is arranged with an angular offset on one side of the drilling plane with respect to bearing part 23' of large surface located in the upper part of the wellbore 4.

The fourth salient part 24' of element 10' has an outer bearing surface whose distance from the axis 14' of the assembly 10' is smaller by a length e than the radius of the nominal section of the hole.

The assembly 10' is relief machined from salient part 21', so as to allow the assembly 10' and the drill bit to be tipped towards the left, when the assembly is in a position close to the position shown in FIG. 7.

FIG. 8 shows an adjusting element 40 according to the invention for enabling a carrying out of an azimuth adjustment either to the left or to the right of the drilling plane, in the direction of penetration of the drill bit.

The adjusting element 40 is interposed on the drill string and integral with this drill string, in the vicinity of the drill bit, as has been described in connection with element 10.

The adjusting element 40 comprises a body substantially symmetrical with respect to an axial plane such as the trace plane PF in FIG. 8 which corresponds to the drilling plane, when the element is in the position shown in FIG. 8.

The body of adjusting element 40 comprises two radial salient parts 41 and 43 whose cross-sections are placed in substantially diametrically opposite positions on the cross-section of a cylinder having the adjusting axis of the element 40 as the axis and the nominal diameter of wellbore 4 as the diameter.

One of the salient parts 41 comprises a small-size outer bearing surface, the body of element 40 being relief machined on either side of salient part 41, with angles of inclination $\alpha D$ and $\alpha G$ substantially equal.

The bearing part 43 opposite bearing part 41 has a cylindrical shape and a large surface.

The body of the adjusting element 40 also comprises two salient parts 42 and 44 whose radius is smaller by a length eG (or eD) than the nominal radius of the wellbore 4.

Two blades 45 and 46, mobile in the axial direction, are mounted respectively within salient parts 42 and 44 of the body of element 40.

Blades 45 and 46 can be displaced between a retracted position inside the body of the adjusting element 40 (blade 45) and an extracted position (blade 46).

In the extracted position thereof, the outer bearing surface of the blade of substantially cylindrical shape is placed in a cylindrical surface having the axis 48 of the element as the axis and substantially the nominal diameter of wellbore 4 as the diameter.

In the retracted position thereof, the blade is entirely seated in the body of element 40, so that a distance eD or eG is provided between the outer surface of the element and the inner wall of hole 4.

Blades 45 and 46 can be displaced between the retracted position and the extracted position thereof by a remote actuating device such as described in, for example, French patent No. 2,575,793 and which may be used for actuating the blades of a variable-diameter stabilizer such as described in, for example, French patent No. 2,579,662. Controlling such an actuating device is achieved remotely, by setting the circulation rate of the drilling fluid in the drill string to a determined value.

The actuating device used in the case of the azimuth-adjusting element shown in FIG. 8 is such that it allows either blade 46 to be extracted and blade 45 to remain in the retracted position, as shown in FIG. 8, or, on the contrary, blade 45 to be extracted and blade 46 to remain in the retracted position.

In the construction shown in FIG. 8, the adjusting element 40 allows the azimuth of the trajectory of a drill bit to be corrected towards the left.

The second configuration of the adjusting element 40 (blade 45 extracted and blade 46 retracted) allows the azimuth of the trajectory to be corrected towards the right.

Using the remote device for actuating blades 45 and 46 thus makes it possible to correct the trajectory, during the rotation of the drill string, towards the right or towards the left.

The adjusting device according to the invention has the advantage of performing a dynamic adjustment of the azimuth, during the rotation of the drill string and without requiring the setting and orienting of a complex mechanical device.

In case of an element comprising blades which can be placed in a retracted position or in an extracted position, azimuth corrections can be conducted successively to the right and to the left of the drilling plane, so as to maintain the trajectory of the drill bit, in a determined direction.

The invention is not limited to the embodiment which has been described.

The geometric shape of the cross-section of the adjusting element may actually be different from the shape that has been described. This adjusting element may comprise a number of bearing blades other than three, and the distribution, shape and size of these bearing blades may be different from those which have been described.

However, it is necessary that one of the bearing blades has an outer contact surface much smaller than that of the other bearing blades. It is also necessary that the element comprises no bearing parts resting against the wall of the wellbore on one side of the axial tipping plane and comprises on the contrary at least one bearing zone on the other side of the plane. Tipping of the element and of the drill bit is thus obtained during part of the rotation of the element, when the small-size bearing zone lies in the vicinity of the lower part of the wellbore.

It is apparent that the shape and the size of the element are defined by the conditions of use of the drill string and that the man skilled in the art may design such an element by using the usual knowledge relative to drill string elements.

The action of the transverse forces of reaction of the wall of the hole on the element generates a displacement of the axis of this element either to the right or to the left, so that, during the full rotation of the element, the axis thereof moves preferably to the right or to the left of the drilling plane, causing the displacement of the tool and a correction of the azimuth trajectory, either to the right or to the left.

It is also apparent that the element according to the invention may consist of one or several materials such as steels used for manufacturing drilling equipments.

Moreover, the salient and/or bearing parts such as described above may have, as shown in FIG. 6, zones 51, 52, 53, 54 having densities $\rho 1$, $\rho 2$, $\rho 3$, $\rho 4$ which may be different so as to emphasize, if need be, the dynamic tipping effects.

In case of an assembly comprising variable-diameter blades, these blades may be controlled through any remote actuating device utilizing the circulation of a drilling fluid or any other means, such as the pressure of a liquid or of a gas.

The invention applies in a general way to the adjustment of the azimuth of the trajectory of a drill bit in the case of any rotary drilling process.

We claim:

1. A device for adjusting an azimuthal direction of a trajectory of a rotary-drilling bit fastened to an end of a drill string rotatable around an axis thereof arranged substantially along a vertical drilling plane during a drilling of a hole, the azimuthal direction of the trajectory being defined by an angular position of the vertical drilling plane with respect to a reference direction, wherein the device comprises at least one drill string element integrally connected with the drill string for rotation and fastened to the drill string in a vicinity of the drilling bit, the drill string element comprising parts having outer bearing surfaces arranged in a cylindrical surface having an axis merged or substantially merged with an axis of the drill string and a maximum diameter equal to or substantially equal to a nominal diameter of the hole, distributed around the axis of the drill string so as to generate, during rotation of the drill string, by reaction of a wall of the hole on the at least one drill string element, forces tipping of the drilling bit out of the vertical drilling plane, either to the right or to the left of the vertical drilling plane, during part of the full rotation of the drill string and to maintain the drill string substantially along an axis of the hole during a remainder of the rotation, and wherein a distance between the axis of the drill string and said outer bearing surfaces is constant during at least one revolution of said drill string.

2. A device for adjusting an azimuthal direction of a trajectory of a rotary-drilling bit fastened to an end of a drill string in rotation around an axis thereof arranged substantially along a vertical drilling plane during a drilling of a hole, the azimuthal direction of the trajectory being defined by an angular position of the vertical drilling plane with respect to a reference direction, the device comprising at least one drill string element integral with the drill string in rotation and fastened to the drill string in a vicinity of the drilling bit, the drill string element comprising parts having outer bearing surfaces arranged in a cylindrical surface having an axis merged or substantially merged with an axis of the drill string and a maximum diameter equal to or substantially equal to a nominal diameter of the hole, distributed around the axis of the drill string so as to generate, during rotation of the drill string, by reaction of a wall of the hole on the at least one drill string element, forces tipping the drilling bit out of the drilling plane, either to the right or to the left of the vertical drilling plane, during part of the full rotation of the drill string and to maintain the drill string substantially along an axis of the hole during a remainder of the rotation, and wherein said at least one drill string element comprises at least three radial salient parts directed toward an outside and arranged substantially in 90° with respect to one another around the axis of the drill string, one of the salient parts comprising an outer bearing surface of a size substantially smaller than the size of outer bearing surfaces of the other two salient parts, said bearing part having the small-sized outer bearing surface being placed in a position substantially diametrically opposite with respect to one of the bearing parts comprising a large-sized outer bearing surface so that the drill string element comprises a bearing part on one side of an axial tipping plane passing said bearing part having a small size outer bearing surface.

3. A device as claimed in claim 2, wherein the at least one drill string element comprises, on one side of the tipping plane, a salient part of substantially cylindrical shape extending along an axis of the at least one drill string element with a radius of said salient part being less than a nominal radius of the well bore.

4. A device as claimed in one of claims 2 or 3, wherein said at least one drill string element comprises a relief portion inclined at an angle $\alpha$ towards an inside and delimiting the bearing part having the small sized outer bearing surface.

5. A device as claimed in one of claims 2 or 3, wherein the bearing part having the small sized outer bearing surface is offset by an angle $\gamma$ either to the right or left, with respect to a diametral plane passing through the center of the bearing surface of the large size bearing part arranged substantially in a diametrically opposite position with respect to the bearing part having the small sized outer bearing surface.

6. A device as claimed in claim 1, wherein the at least one drill string element comprises a body having two radially outwardly extending projecting parts respectively having cross sections through a transverse plane perpendicular to an axis of the element and disposed substantially in diametrically opposite positions with respect to each other, one of said two radially outwardly projecting parts including a bearing part having an outer bearing surface of a small size with respect to an outer bearing surface of the second radially projecting part, and two variable-diameter bearing blades are placed in substantially diametrically opposite positions and at substantially 90° with respect to the outwardly projecting parts, wherein the bearing blades are associated with an actuating means for enabling an extension or retraction alternately in an independent manner.

7. A device as claimed in claim 6, wherein the body of the at least one drill string element is relief machined so as to be inclined on either side of the bearing part having the small sized outer bearing surface.

8. A device as claimed in one of claims 6 or 7, wherein the bearing blades are movable in a radial direction between the extended position thereof within the body and the extracted position thereof by a predetermined distance, so that an outer surface of each of the blades in the extracted position lies in a cylinder having substantially an axis corresponding to the axis of the drill string as the axis and substantially the diameter of the hole as the diameter and, in a retracted position, by a predetermined radial distance in the retracted position.

9. A device as claimed in claim 2, wherein the outer bearing surfaces and the salient parts comprise zones made of materials having different densities.

* * * * *